US008155548B2

(12) United States Patent
Sheflin et al.

(10) Patent No.: US 8,155,548 B2
(45) Date of Patent: Apr. 10, 2012

(54) DYNAMIC PROCESS CONTROL FOR PRINTING DEVICES IN THE PRESENCE OF RELOAD DEFECTS

(75) Inventors: Joseph C. Sheflin, Macedon, NY (US); Jack T. Lestrange, Macedon, NY (US); Peter Paul, Webster, NY (US); Aaron M. Burry, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 932 days.

(21) Appl. No.: 12/176,736

(22) Filed: Jul. 21, 2008

(65) Prior Publication Data

US 2010/0014877 A1 Jan. 21, 2010

(51) Int. Cl.
*G03G 15/00* (2006.01)

(52) U.S. Cl. ..... 399/72; 399/49

(58) Field of Classification Search ..... 399/49, 399/72

See application file for complete search history.

(56) References Cited

U.S. PATENT DOCUMENTS

| | | | | |
|---|---|---|---|---|
| 4,338,880 | A | 7/1982 | Tabuchi et al. | |
| 5,652,946 | A | 7/1997 | Scheuer et al. | |
| 6,016,204 | A | 1/2000 | Budnik et al. | |
| 6,462,821 | B1 | 10/2002 | Borton et al. | |
| 6,904,255 | B2 | 6/2005 | Kera et al. | |
| 7,024,152 | B2 | 4/2006 | Lofthus et al. | |
| 7,136,616 | B2 | 11/2006 | Mandel et al. | |
| 7,177,585 | B2 | 2/2007 | Matsuzaka et al. | |
| 2004/0240902 | A1 * | 12/2004 | Dalal et al. | 399/49 |
| 2006/0109487 | A1 | 5/2006 | Klassen | |
| 2007/0200908 | A1 * | 8/2007 | Kin et al. | 347/140 |

* cited by examiner

*Primary Examiner* — David Gray
*Assistant Examiner* — Billy J Lactaoen
(74) *Attorney, Agent, or Firm* — Pillsbury Winthrop Shaw Pittman LLP

(57) ABSTRACT

Methods and systems are provided for controlling a printing device in the presence of reload defects. According to a first embodiment, a controller is provided to manage the printing of scheduled control patches immediately after an image of a print job. Accordingly to a second embodiment, a controller is configured to manage the printing of an image or a print job immediately after a control patch.

21 Claims, 11 Drawing Sheets

DYNAMIC PROCESS CONTROL FOR PRINTING DEVICES IN THE PRESENCE OF RELOAD DEFECTS

FIELD

This application relates to document processing systems and methods to control printing devices in the presence of reload defects.

BACKGROUND

Xerographic and electrophotographic printing and marking engines schedule control patches for calibration and other machine diagnostic procedure. The control patches are printed between images in what is called "inter-document zones" (IDZ) on the photoreceptor belt and/or other image transfer member using a calibration procedure having a desired toner area coverage, for example, as disclosed in U.S. Pat. No. 6,016,204, which is incorporated by reference herein in its entirety. The areas of the image transfer member where images of the print job are printed, by contrast, are called the "customer image zones," or "image zones."

The control patches may include one or more toner density patches. The toner area coverage, AC is defined as the percentage of toner area covering a unit halftone cell in a sample target that is available to reflect. As known in the art, control patches may be varied uniformly for each test patch from 0 to 100%. These control patches are sensed and machine parameters may be adjusted to maintain a tone reproduction curve (TRC).

As the marking engine's performance degrades over time, different image quality (IQ) problems may arise. In particular, one IQ problem of concern is reload. Reload defects may occur when the reload performance of the developer apparatus degrades to the point where the customer image impacts the control patches, and/or, the control patches impacts the customer image.

FIG. 1 illustrates a known developer apparatus 100 in an electrophotographic printing system. Such a system is disclosed, for example, in U.S. Patent Application Publication No. 2006/0109487, which is incorporated by reference herein in its entirety.

The apparatus 100 includes a reservoir 164 containing developer material 166. The reservoir includes augers, indicated at 168, which are rotatably-mounted in the reservoir chamber. Augers 168 serve to transport and to agitate the material within the reservoir and encourage the toner particles to charge and adhere triboelectrically to the carrier granules. Magnetic brush roll 170 transports developer material 166 from the reservoir to loading nips 172, 174 of donor rolls 176, 178. Metering blade 180 removes excess developer material from the magnetic brush roll and ensures an even depth of coverage with developer material before arrival at the first donor roll loading nip 172.

At each of the donor roll loading nips 172,174, toner particles are transferred from the magnetic brush roll 170 to the respective donor roll 176,178. The carrier granules and any toner particles that remain on the magnetic brush roll 170 are returned to the reservoir 164 as the magnetic brush continues to rotate. The relative amounts of toner transferred from the magnetic roll 170 to the donor rolls 176, 178 can be adjusted, for example by: applying different bias voltages to the donor rolls; adjusting the magnetic to donor roll spacing; adjusting the strength and shape of the magnetic field at the loading nips and/or adjusting the speeds of the donor rolls.

Each donor roll transports the toner to a respective development zone 182,184 through which the photoconductive belt 10 passes. At each of the development zones 182, 184, toner is transferred from the respective donor roll 176, 178 to the latent image on the belt 10 to form a toner powder image on the latter.

In the device of FIG. 1, each of the development zones 182, 184 is shown as having a pair of electrode wires 186, 188 disposed in the space between each donor roll 176, 178 and belt 10. The electrode wires may be made from thin (for example, 50 to 100 micron diameter) stainless steel wires closely spaced from the respective donor roll. The wires are self-spaced from the donor rolls by the thickness of the toner on the donor rolls and may be within the range from about 5 micron to about 20 micron (typically about 10 micron) or the thickness of the toner layer on the donor roll.

For each of the donor rolls 176 and 178, the respective electrode wires 186 and 188 extend in a direction substantially parallel to the longitudinal axis of the donor roll. An alternating electrical bias is applied to the electrode wires by an AC voltage source 190. The applied AC establishes an alternating electrostatic field between each pair of wires and the respective donor roll, which is effective in detaching toner from the surface of the donor roll and forming a toner cloud about the wires, the height of the cloud being such as not to be substantially in contact with belt 10.

After development, excess toner may be stripped from donor rolls 176 and 178 by respective cleaning blades (not shown) so that the magnetic brush roll 170 meters fresh toner to the clean donor rolls. As successive electrostatic latent images are developed, the toner particles within the developer material 166 are depleted. A developer dispenser 105 stores a supply of toner particles, with or without carrier particles. The dispenser 105 is in communication with reservoir 164 and, as the concentration of toner particles in the developer material is decreased (or as carrier particles are removed from the reservoir as in a "trickle-through" system or in a material purge operation as discussed below), fresh material (toner and/or carrier) is furnished to the developer material 166 in the reservoir. Developer housing 164 may also include an outlet 195 for removing developer material from the housing in accordance with a developer material purge operation as discussed in detail below. Outlet 195 may further include a regulator (not shown) such as an auger or roller to assist in removing material from the housing.

Each donor roll rotates and when it completes a full rotation, the donor roll has toner with different charge/mass ratio than regions where the toner has been on the roll for multiple revolutions. In particular, the toner on the donor roller may be less in regions of the donor roll where toner was removed during previous revolutions. This leads to the possibility of a reload defect, which appears as a lighter area in the subsequent regions. As a result, a "ghost" image of a previous control patch may be printed with a customer image or vice versa.

FIG. 2 illustrates a plot of the toner mass on a region of a donor roll in the developer apparatus immediately after printing. As the donor roll continues to rotate more and more toner will accumulate on the donor roll, thereby replenishing the toner mass on the donor roll. This process may take multiple revolutions of the donor roll. After a sufficient number of rotations, the toner mass at that region of the donor roll will be completely replenished (mass $M_o$).

A problem arises, however, where an image to be printed requires more toner (mass $M_1$) than that region of the donor roll might be presently able to provide (mass $M_2$), i.e., before that region of the donor roll has been replenished with toner. If so, there may be the possibility of a reload artifact appearing in the printed document.

One possible solution is to image control patches in an edge zone on the photoreceptor belt to ensure that the control patches do not interfere with the customer print zone. Such a solution was disclosed, for example in U.S. patent application Ser. No. 11/931,721 filed Oct. 31, 2007, herein incorporated by reference in its entirety. However, for some print systems this may not be feasible.

SUMMARY

According to one aspect of the application, a method for controlling a printing device in the presence of reload defects is provided, comprising: printing an image of a print job on an image transferring member of the printing device; determining the density of the image or a portion thereof that was printed; and subsequently printing a scheduled control patch on the image transferable member if the density of the image is less than a predetermined density threshold.

According to another aspect of the application, a method for controlling a printing device in the presence of reload defects is provided, comprising: printing a control patch on an image transferring member of a printing device; determining the density of an image of a print job or a portion thereof to be printed; and subsequently printing the image on the image transferable member if the density of the image is less than a predetermined density threshold.

According to yet another aspect of the application, a system for controlling a printing device in the presence of reload defects is provided, comprising: an image transfer member for receiving images of a print job and control patches; and a controller configured to print a scheduled control patch immediately after an image of the print job if the density of the image or a portion thereof is less than a predetermined density threshold.

According to a further aspect of the application, a system for controlling a printing device in the presence of reload defects is provided, comprising: an image transferring member for receiving images of a print job and control patches; and a controller configured to print an image of the print job after a control patch is printed, if the density of the image or a portion thereof is less than a predetermined density threshold.

Other objects, features, and advantages of one or more embodiments of the present application will seem apparent from the following detailed description, and accompanying drawings, and the appended claims.

BRIEF DESCRIPTION OF THE DRAWINGS

Embodiments of the present application will now be disclosed, by way of example only, with reference to the accompanying schematic drawings in which corresponding reference symbols indicate corresponding parts, in which.

DETAILED DESCRIPTION

The terms "print," "printing," and/or "printed," as used herein may refer to printing on the output media of a printing device, as well as, printing or otherwise marking on one or more intermediate transfer members of the printing device. The term "customer image" as used herein may refer to images of print jobs as opposed to images for control patches and/or other diagnostic targets.

The inventors performed testing to determine the impact of printing customer images in close proximity to control patches had on the occurrence of reload defects.

Figure 3:
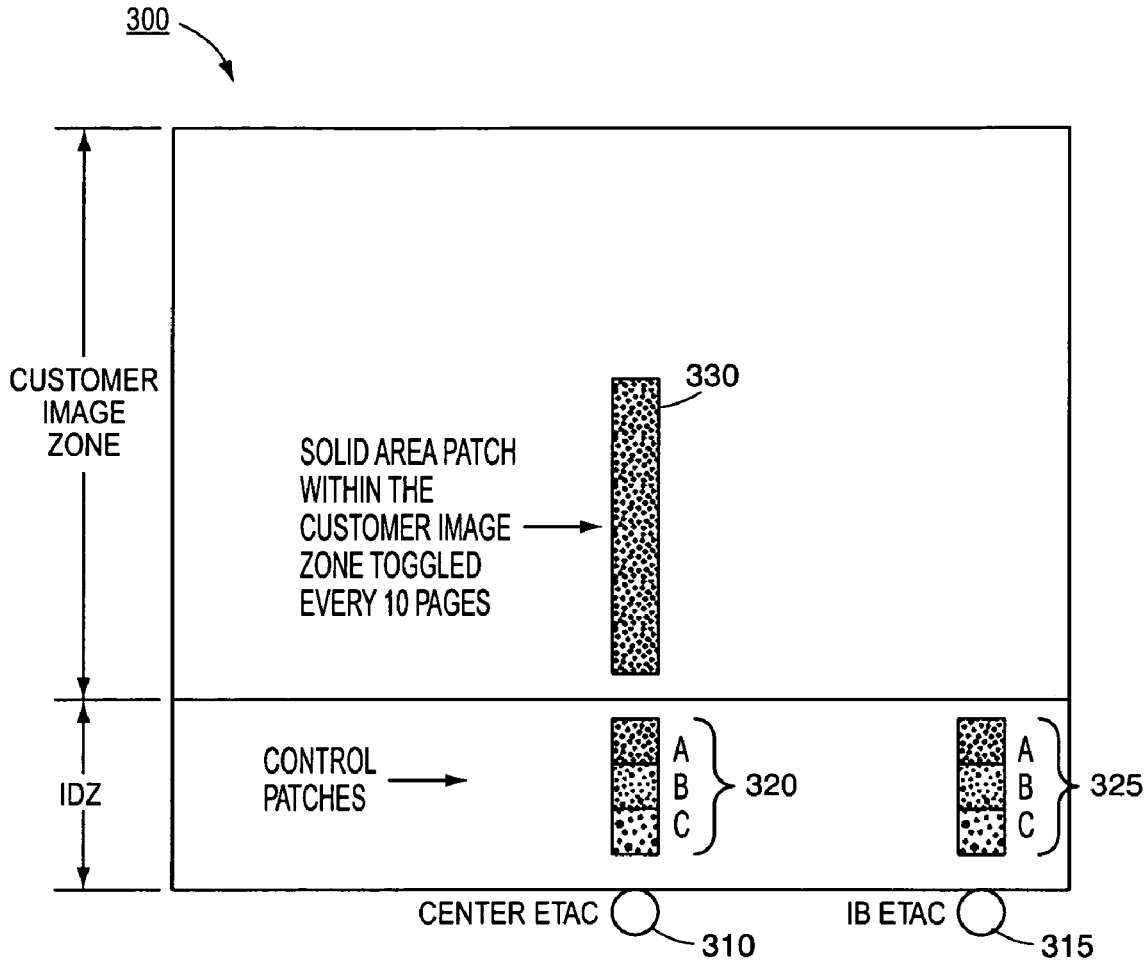
FIG. 3 illustrates a test arrangement used to determine the relative impact that the printing customer images has on control patches.

FIG. 3 illustrates one exemplary test arrangement used by the inventors. A plurality of customer image zones and inter-document zones (IDZ) are positioned, for example, on a portion of a photoreceptor belt 300 in a xerographic printing machine.

The test was carried out using a Xerox iGen3® digital printing press. A pair of enhanced toner area coverage (ETAC) sensors 310, 315, were positioned to sense control patches in the center position and lateral position on the photoreceptor belt 300 of the machine. The lateral sides of the photoreceptor 300 may be referred to as the inboard (OB) and outboard (OB) positions relative to an operator's position. In this scenario, the second sensor 315 was position at the inboard position (i.e., closest to the operator).

A solid area patch 330 was provided in the customer image zone in-line with a first control patch 320 to simulate the impact on of a "dark" customer image on the control patches and vice versa. The solid area patch 330 and the first control patch 320 were both sensed using the center ETAC sensor 310.

A second control patch 325 was positioned at the inboard (IB) side of the IDZ with no corresponding solid area patch in the customer image zone as a control, which would not be effected by the solid area patch 330. The second control patch 325 was sensed using the inboard ETAC sensor 315.

The first and second control patches 320, 325 were essentially identical and each included a solid area patch 320A, 325A (100% AC), a mid-density patch 320A, 325B (67% AC), and a low-density patch 320C, 325C (17% AC).

The test was run for a total of 50 pages, with each page corresponding to an adjacent customer image zone and an IDZ on the photoreceptor belt 300. The solid area patch 330 in the customer image zone was toggled on for every other set of 10 pages (i.e. when pages 11-20 and 31-40 were printed).

Figure 4:
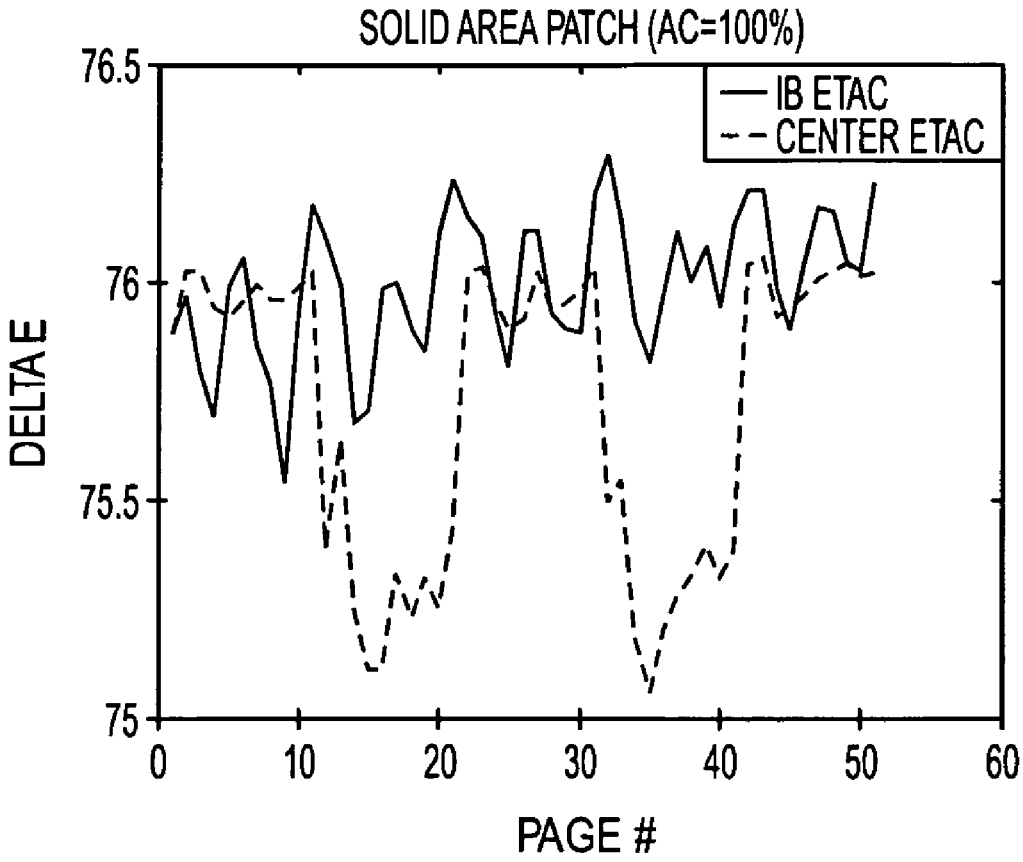
FIG. 4 illustrates a plot of the sensor readings for the inboard ETAC and center ETAC sensors when sensing the solid area patch of the control patches.
Figure 5:
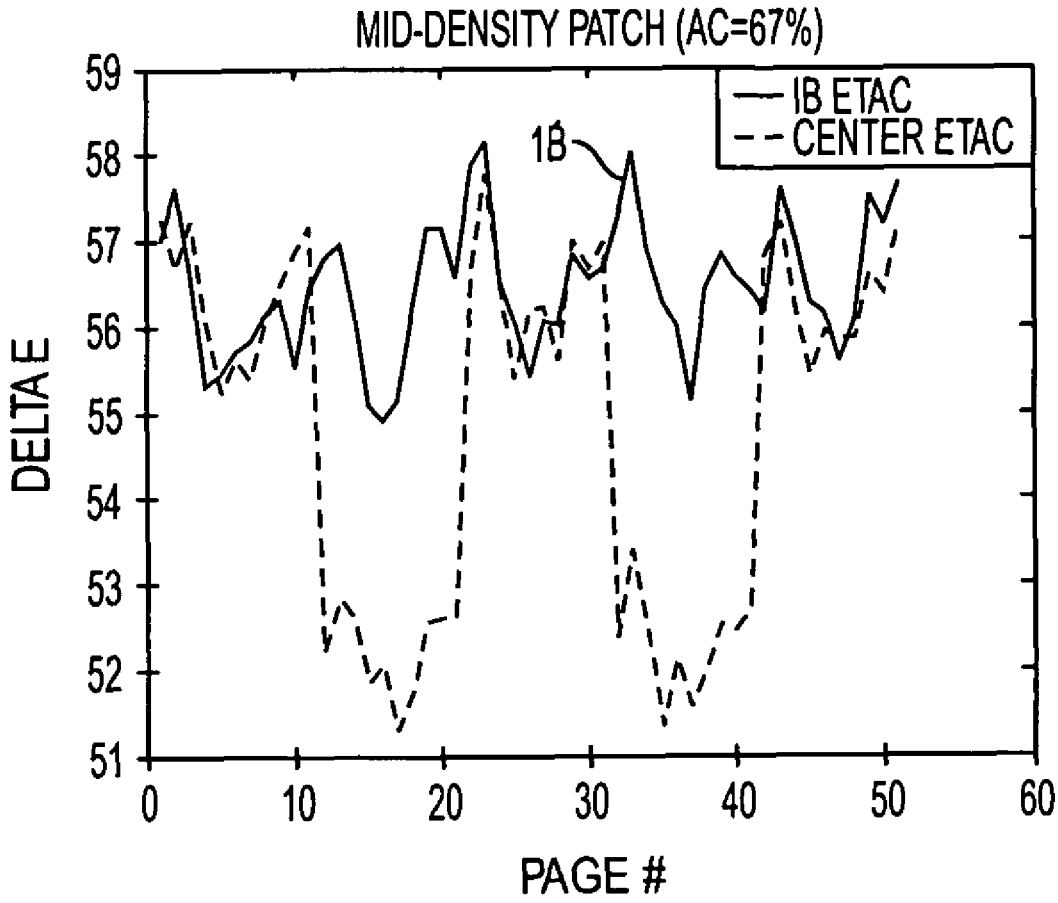
FIG. 5 illustrates a plot of the sensor readings for the inboard ETAC and center ETAC sensors when sensing the mid-density patch of the control patches.
Figure 6:
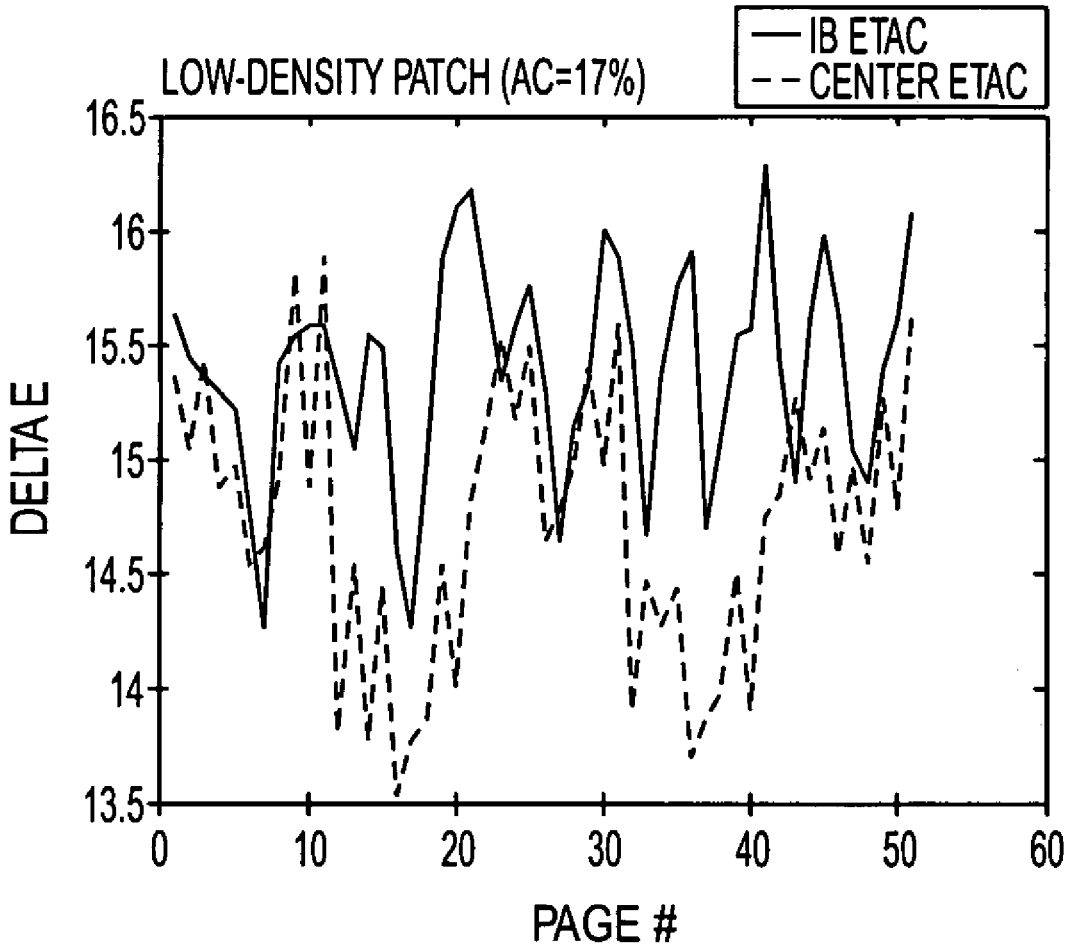
FIG. 6 illustrates a plot of the sensor readings for the inboard ETAC and center ETAC sensors when sensing the low-density patch of the control patches.

FIGS. 4-6 illustrate plots of sensor readings for the IB ETAC and center ETAC sensors, and the impact that toggling the solid area patch 330 in the customer image zone had on the high-density patch, the mid-density patch, and the low-density patch, respectively. The sensor readings are in Delta E.

It is apparent from the results, that printing the solid area patch 330 in the customer image zone impacted the subsequent printing of the first control patch 320. For example, referring to pages 11-20 and 31-40, where there was a solid area patch 330 that had been printed in the customer image zone, there was a large shift in density for the solid area or solid area patch (FIG. 4) and the mid-patch (FIG. 5). Moreover, the results show that the density shift for the mid-density patch was most significantly impacted.

By contrast, the low-density patches (FIG. 6) did not exhibit a significant shift in density, for pages 11-20 and 31-40, where there was a solid area patch 330 printed in the customer image zone.

The results of this testing demonstrate the remarkable effect that the customer image has on printing control patches. However, when the density of the customer image is less than a predetermined density threshold, the customer image cannot significantly affect the control patches.

Thus, a methodology is provided to control a printing device in the presence of reload defects. The disclosed embodiments minimize and/or eliminate the possibility that the customer image negatively impacts the control patch, and vice versa.

Figure 7:
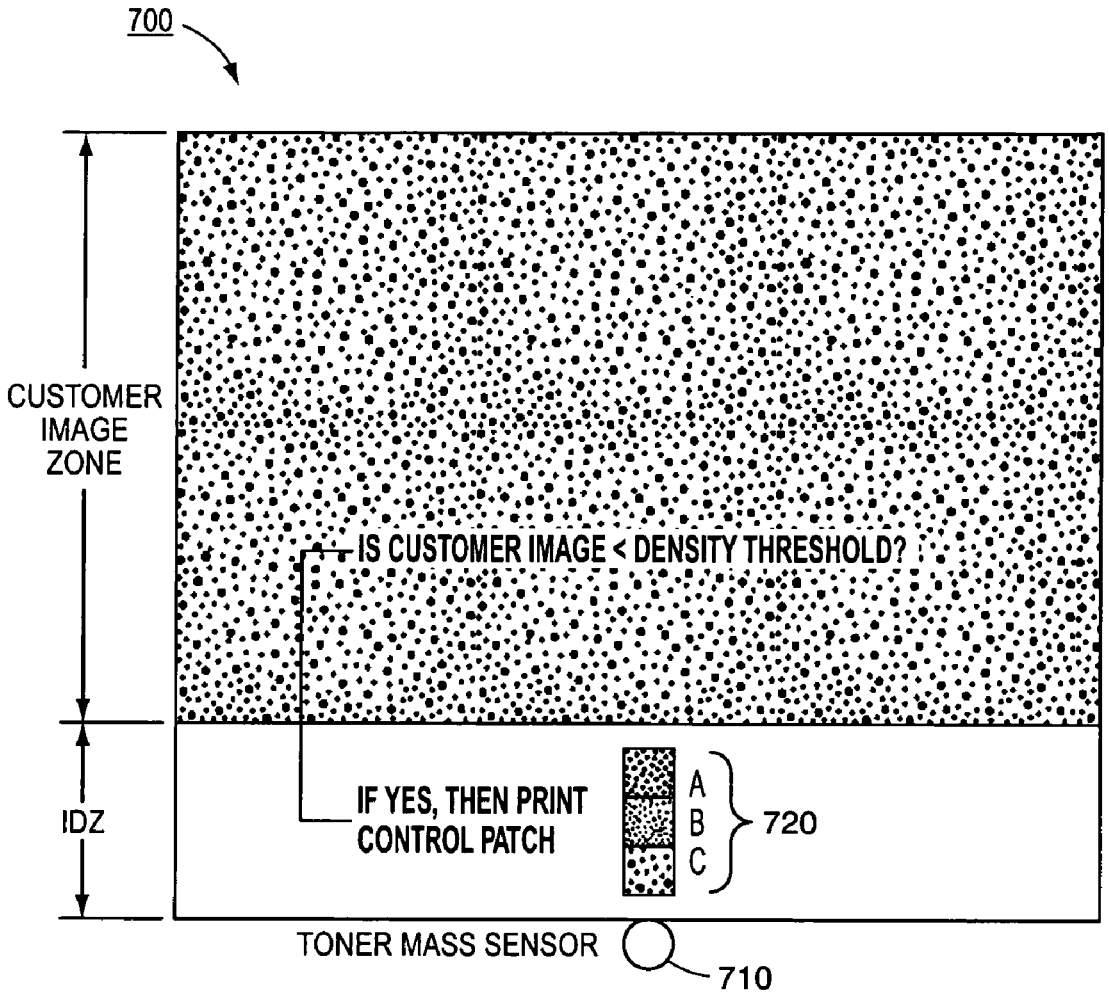
FIG. 7 illustrates printing of a control patch, according to a first embodiment of the application.

FIG. 7 illustrates printing a control patch, according to a first embodiment of the application.

A portion of a photoreceptor belt 700, for example, from a xerographic printing machine is shown and generally includes a plurality of customer image zones and inter-document zones (IDZ). It will be also appreciated that the inter-document zone (IDZ) and customer image zones may be similarly provided on an intermediate transfer member of a printing device, for example, as disclosed in U.S. Pat. Nos. 7,177,585 and 6,904,255, herein incorporated by reference in their entirety.

The customer images zones and the inter-document zones (IDZ) may be spaced in an alternating manner on the image transfer member. Generally, control patches and other diagnostic targets are printed in inter-document zones (IDZ) of the image transfer member while images of the print job are printed on customer image zones, although this need not always be the case.

A sensor 710 is positioned proximate to the photoreceptor belt 700 and is configured to sense control patches 720 in inter-document zones (IDZ) and images in the customer image zones.

The control patch 720 may include a solid area/high-density patch 720A (100% AC), a mid-density patch 720B (67% AC), and a low-density patch 720C (17% AC). See, for example, U.S. Pat. No. 6,016,204, mentioned above. Other control patches and geometries may similarly be provided.

In one implementation, the sensor 710 may be a toner mass sensor, such, as for example, a densitometer or an enhanced toner area coverage (ETAC) sensor. While the sensor 710 is shown centrally located, it will be appreciated that the sensor 710, or additional sensors, may be positioned at other locations with respect to the photoreceptor belt, such as at the inboard (IB) or outboard (OB) sides of the belt.

According to the first embodiment, a controller is provided to manage the printing of scheduled control patches immediately after printing a customer image. In particular, only if the controller determines that the density of the customer image that was just printed is less than a predetermined-threshold will the scheduled control patch be printed. Otherwise, the controller will skip printing the scheduled control patch so that no interaction between control patch and customer image can occur. In some implementations, the skipped control patch may be rescheduled to a later instance for printing.

Figure 8:
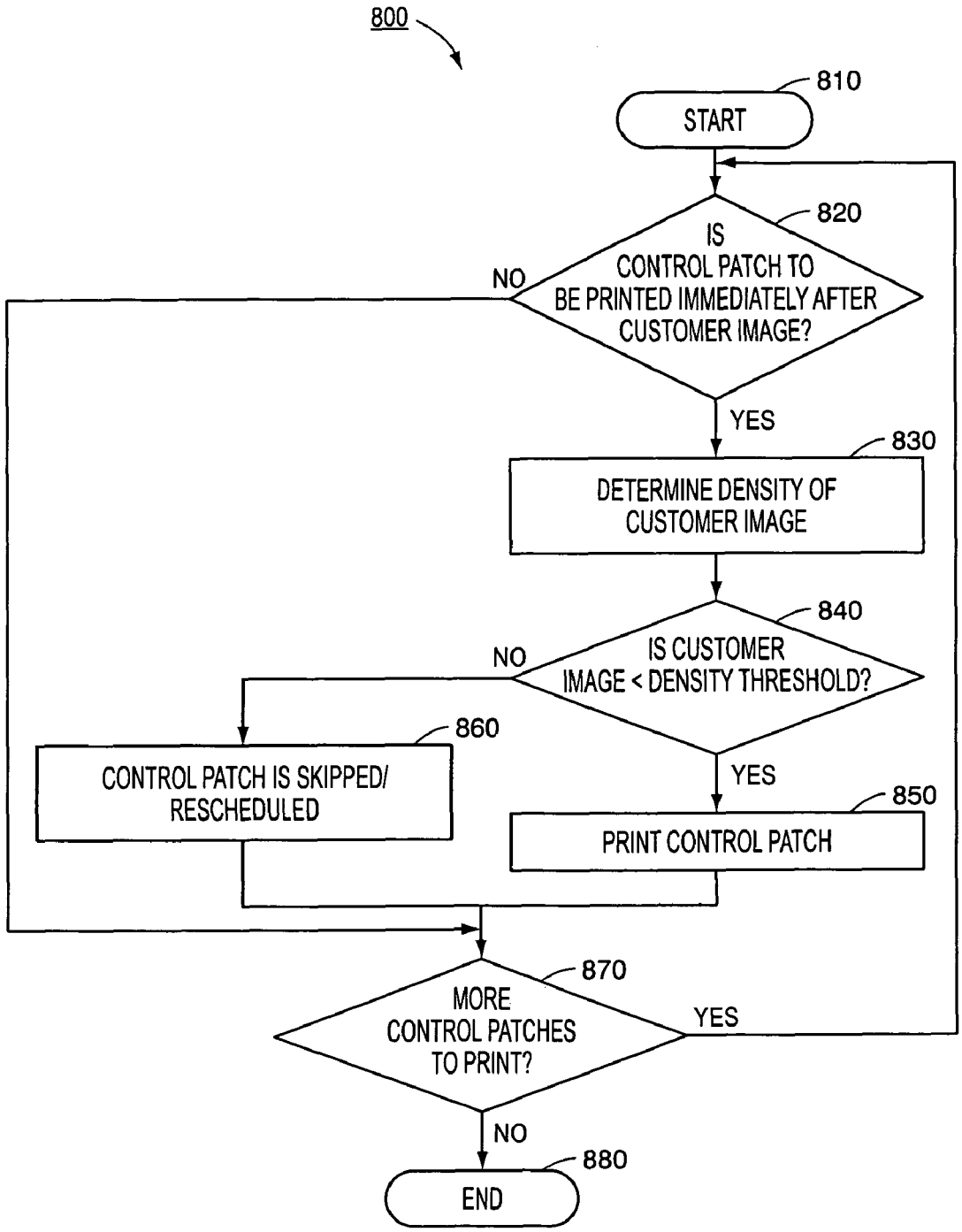
FIG. 8 illustrates a controller logic process, according to a first embodiment of the application.

FIG. 8 illustrates a controller logic process, according to the first embodiment. The process begins in step 810. In step 820, the controller determines whether a scheduled control patch is to be printed immediately after a customer image. If not, the process proceeds to step 870.

In step 830, the controller determines the density of the customer image which has just been printed. This data may be provided to the controller by one or more sensors, e.g., ETAC sensors.

Alternatively, the density of the customer image may be inferred from the digital image content input to the printing machine. The input image data may be provided from the print controller (not shown) of the printing system. The Xerox FreeFlow™ DocuSP™ digital front end (DFE), for example, includes a 40 page look-ahead at a resolution of 75 dpi which may be used to infer the density of an upcoming customer image.

The print controller sends both the input image data from the image, and the control information to the marking engines. The print controller may include a raster image processor (RIP) that accepts an input Page Description, for example, as described by a page description language (PDL), such as Adobe® PostScript®, and produces a bitmap. Generally, for graphics and text, the color representation in PostScript is 'real,' or floating point, and is represented in 32 or 64 bits. For objects that are images (e.g., a JPG file), they are generally 8 bits per color separation (CMYK), but can also be 12 or 16 bits (though this is not as common). Where the PDL of the incoming image data is different from the PDL used by the printing system, a suitable conversion unit (not shown) located in the interface unit may convert the incoming PDL to the PDL used by the digital printing system.

The bitmap may be passed to an image output terminal (IOT) interface of the printing system. The IOT interface may further perform image processing to make corrections or compensations to correct for deviations in the printing process. Grayscale image data is advantageously provided to the IOT interface because binary data cannot be easily image processed, without more complicated image processing to convert it back to something like grayscale.

For 8 bit color separations, for example, each pixel will have a value between 0 and 255. Thus, for a given region of an image, the density may be determined based on the predominant density of pixels therein. In one implementation, an averaging algorithm may be used to determine an average value of the pixels in that region for that color separation. These values may be divided by 255 to give an inferred density value between 0.0 (0% AC) and 1.0 (100% AC) for a particular color.

In step 840, the controller compares the density of the customer image with a predetermined density threshold. This may be a Boolean operation. If the customer image is light enough (i.e., low density) not much toner from the donor roll will be needed to print the image and it will not substantially affect the subsequent printing of the control patch.

In one implementation, a scheduled control patch will only be printed immediately after a customer image has been printed, only if the customer image is less than about 55% AC. Otherwise, if the customer image is greater than about 55%, the subsequent printing of the control patch could cause a reload defect to occur.

Next, in step 850, the scheduled control patch will be printed if the density of the customer image is less than the predetermined density threshold. If not, in step 860, the control patch will not be printed at that time. In some implementations, the printing of the control patch may be rescheduled, by the controller, to be printed at the next available (or later) instance.

In step 870, if further customer images are to be printed (i.e., the print job not completed), the process returns to step 820. Otherwise, the process ends at step 880.

Figure 9:
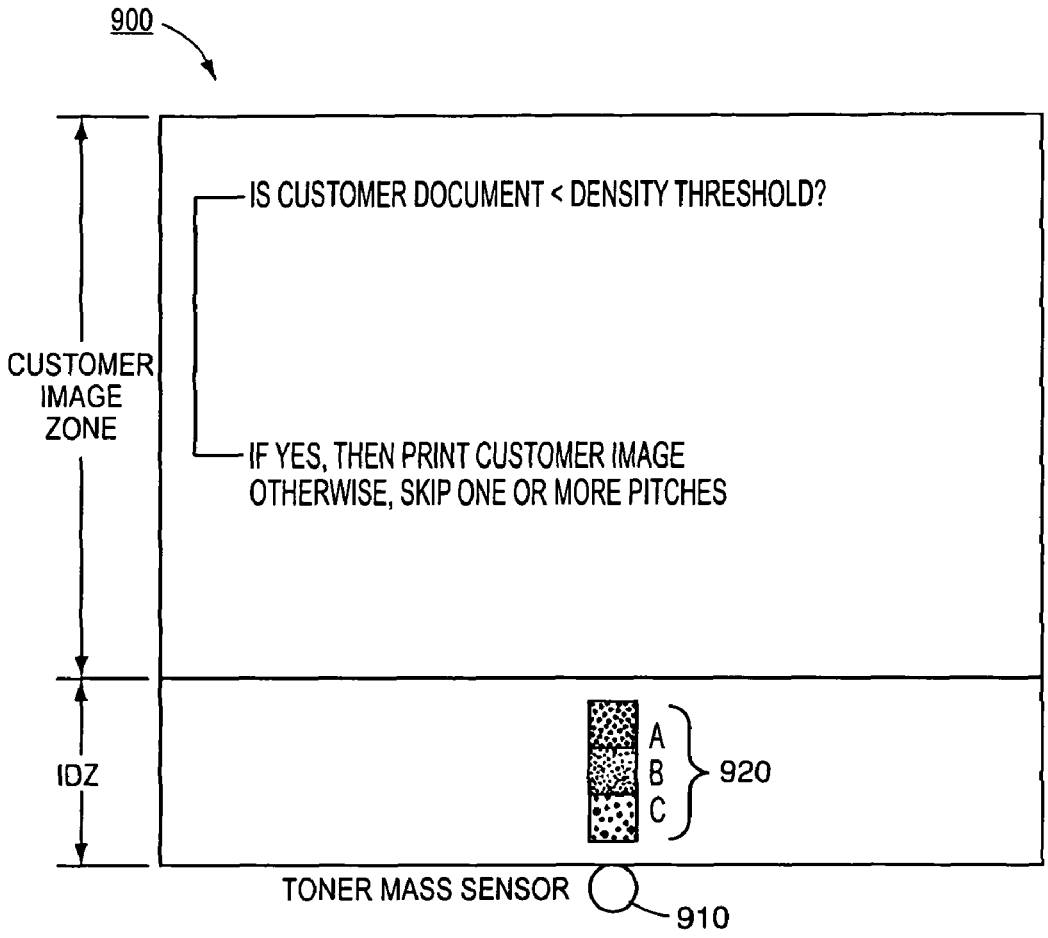
FIG. 9 illustrates printing of a customer document according to a second embodiment of the application.

FIG. 9 illustrates printing of a customer document according to a second embodiment of the application.

A portion of a photoreceptor belt 900, for example, from a xerographic printing machine is shown and generally includes a plurality of customer image zones and inter-document zones (IDZ). The customer images zone and the inter-document zones (IDZ) may be spaced in an alternating manner on the image transfer member.

A sensor 910 is positioned proximate to the photoreceptor belt 900 and is configured to sense control patches 920 in inter-document zones (IDZ) and images in the customer image zones.

The control patch 920 may include a solid area/high-density patch 920A (100% AC), a mid-density patch 920B (67% AC), and a low-density patch 920C (17% AC). See, for example, U.S. Pat. No. 6,016,204, mentioned above. Other control patches and geometries may similarly be provided.

In one implementation, the sensor 910 may be a toner mass sensor, such as, for example, a densitometer or an enhanced toner area coverage (ETAC) sensor. While the sensor 910 is shown centrally located, it will be appreciated that the sensor 910, or additional sensors, may be positioned at other locations with respect to the photoreceptor belt, such as on the inboard (IB) or outboard (OB) sides of the belt 900.

Figure 1:
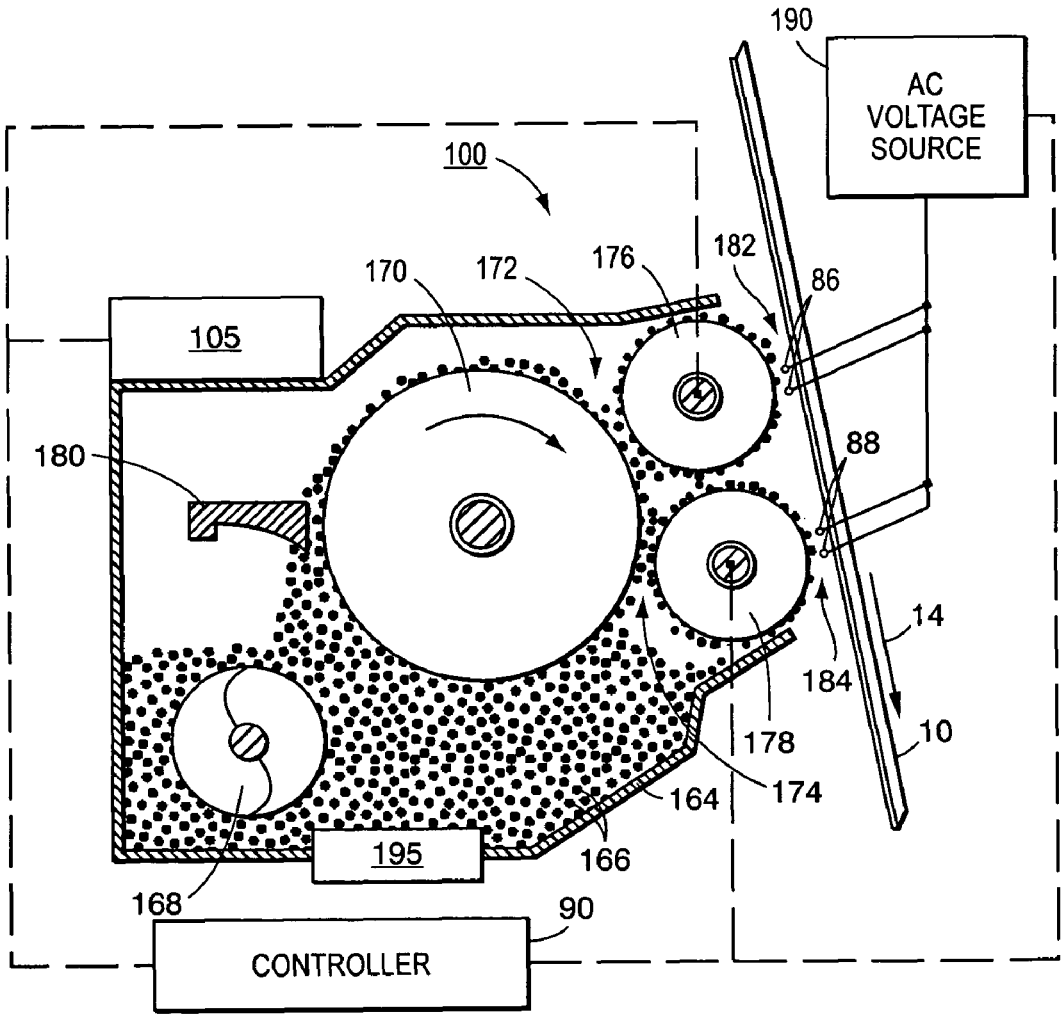
FIG. 1 (RELATED ART)
FIG. 1 illustrates a developer apparatus in an electrophotographic printing system.
Figure 2:
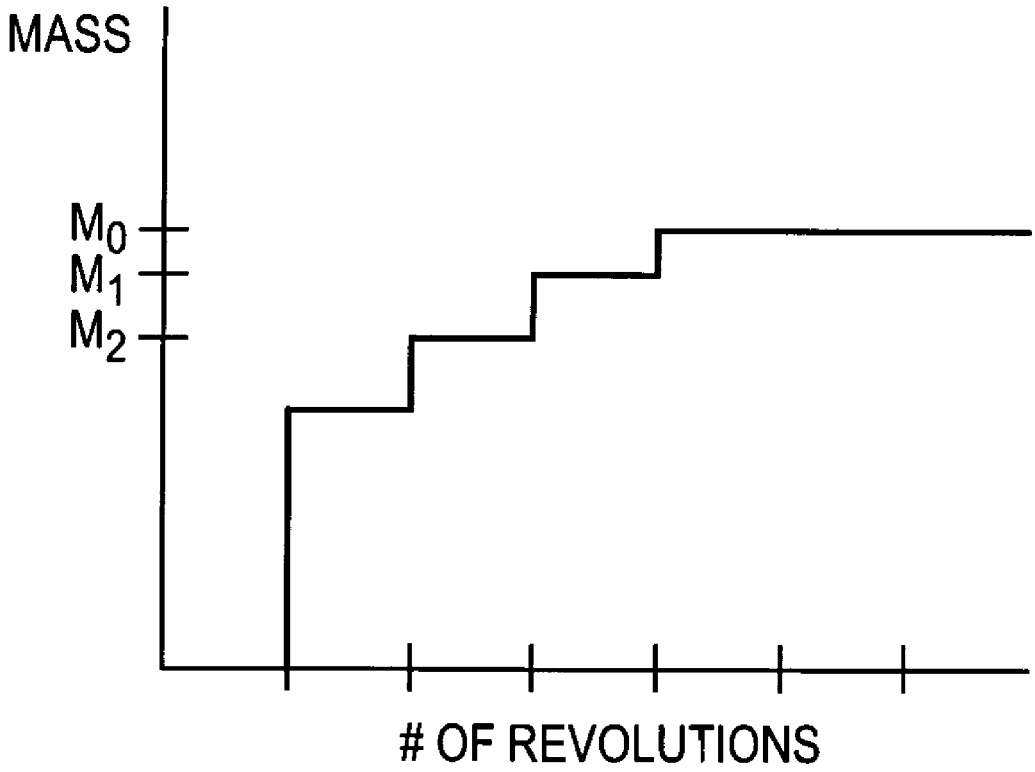
FIG. 2 illustrates a plot of the toner mass on a region of a donor roll in a developer apparatus after printing a control patch.

One pitch may be defined to be equal to one customer image zone on the image transfer member (e.g., a photoreceptor belt). The number of skipped pitches may be selected, so as to make certain that the donor roll has rotated a sufficient number of times to replenish with toner (see FIG. 2). A single pitch may be sufficient to skip to reduce the impact of reload. In some implementations, a plurality of pitches may be skipped to further improve quality, although, this may lower productivity.

In other implementations, the number of pitches to be skipped may be determined dynamically, for example, from the reload potential (sensitivity) of the input image data. The reload characteristics of the donor roll may be detectable through measurements of geometry of the process control patches, and measurements of the density of customer images before and after process control patches at the reload geometry. See, for example, U.S. Patent Application Publication No. 2006/0109487, mentioned above.

Accordingly to the second embodiment of the application, a controller is configured to manage the printing of customer images immediately after printing a control patch. In particular, only if the controller determines that the density of the customer image is less than a predetermined-threshold will the customer image be printed. Otherwise, the controller will skip one or more "pitches," before printing the customer image so that no interaction between the customer image and control patch can occur.

Figure 9A:
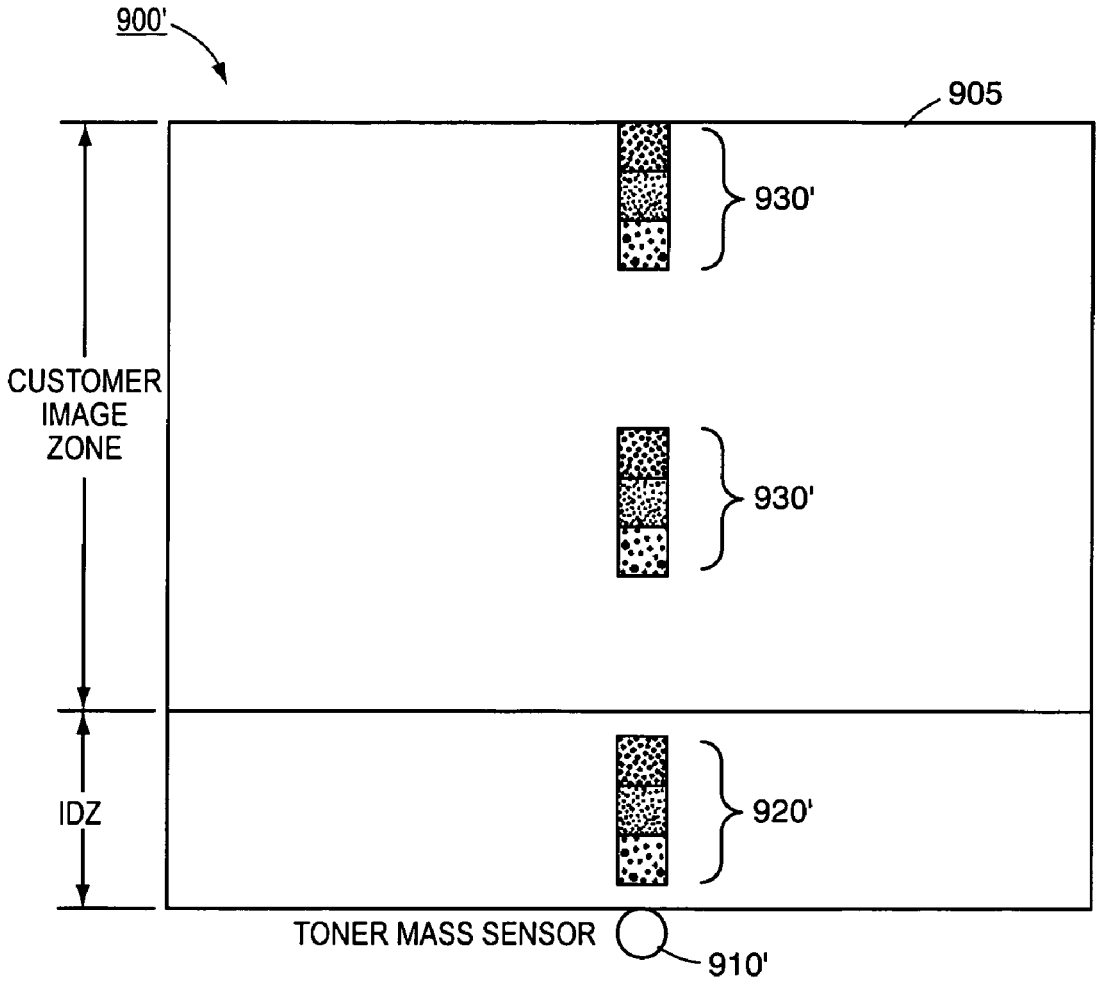
FIG. 9A illustrates printing one or more control patches in a skipped customer image zone, according to a second embodiment of the application.

In some implementation, one or more control patches may be printed in the skipped customer image zone(s) (i.e., the skipped pitch(es)). FIG. 9A illustrates printing two control patches 930' in a skipped customer image zone 905 on the photoreceptor belt 900'.

A sensor 910' is positioned proximate to the photoreceptor belt 900' and is configured to sense control patches 920' in the inter-document zones (IDZ) and images in the customer image zones. Additional control patches and/or other diagnostic targets might also be printed in the skipped customer image zone, so long as there is sufficient space for reload defects not to impact the control patches.

Figure 10:
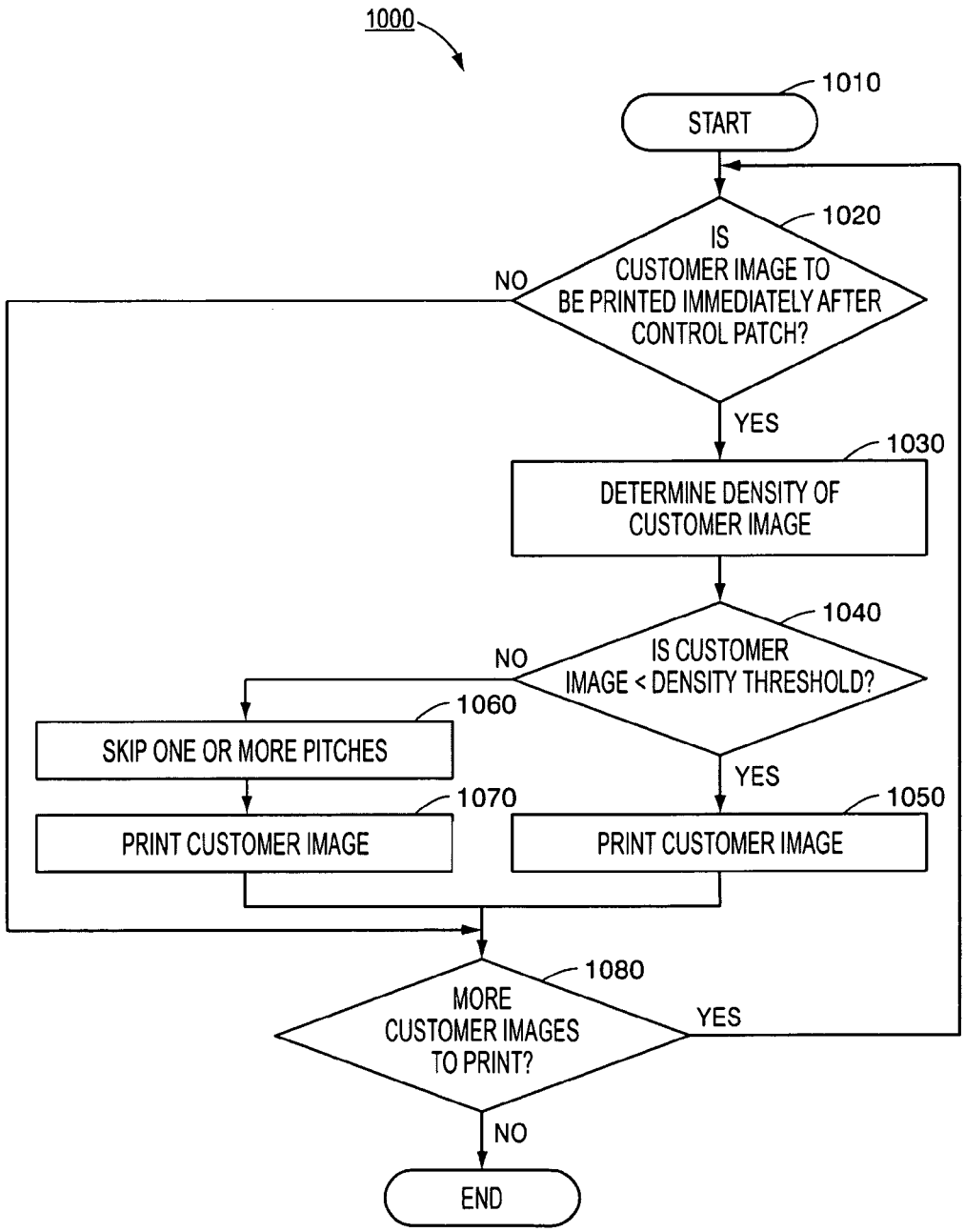
FIG. 10 illustrates a controller logic process, according to a second embodiment.

FIG. 10 illustrates a controller logic process, according to the second embodiment. The process begins in step 1010. In step 1020, the controller determines whether a customer image is to be printed immediately after a scheduled control patch. If not, the process proceeds to step 1080.

Next, in step 1030, the controller determines the density of the customer image to be printed. This density of the customer image may be inferred from the digital image content input to the printing machine (see step 830).

In step 1040, the controller compares the density of the customer image to be printed with a predetermined density threshold to prevent the possibility of a reload defect. This may be a Boolean operation. If the customer images is light enough (i.e., low density), not much toner will be needed to be transferred from the donor roll to print the image and it will not be substantially effected by the control patches.

In one implementation, the customer image will be printed immediately after a control patch has been printed, only if the customer image is less that about 20% AC. Otherwise, if the customer image is greater than about 20% AC, the reload defect could occur.

Next, in step 1050, the customer image will be printed at that time only if the density of the customer image is less than the predetermined density threshold. If not, in step 1060, the controller will skip one or more pitches, and then print the customer image in step 1070.

In step 1080, if more customer images will be printed (i.e., the print job not completed), the process returns to step 1020. Otherwise, the process ends at step 1090.

The benefit of skipping the customer image when the control patches are printed may be seen in FIGS. 4-6, between the center ETAC sensor and the IB ETAC sensor data. For example, when printing pages 11-20 and 31-40, where there was a solid area patch printed in the customer image zone prior to the center control patches, there was a large shift in density for the mid-density and high-density patches.

This embodiment may be advantageous for tightly integrated parallel printing (TIPP) systems. Such systems are known where multiple printing machines are controlled to output a single print job, as disclosed in U.S. Pat. Nos. 7,136,616 and 7,024,152, herein incorporated by reference in their entirety. If one or the marking engines needs to skip a pitch, the other marking engines may still be printing other customer prints. Thus, productivity may not be significantly compromised.

In a third embodiment, a controller may be provided that is configured for enabling both the first and second embodiments. This third embodiment advantageously covers printing control patches immediately after customer images, printing customer images immediately after control patches, or both.

The controllers disclosed herein may be dedicated hardware like ASICs or FPGAs, software, or a combination of dedicated hardware and software. For the different applications of the embodiments disclosed herein, the programming and/or configuration may vary. The controllers may be incorporated, for example, into a print controller or marking engine controller of a printing device.

This application may be particularly important for minimizing and/or eliminating multi-source two-dimensional defects that are interactive with each other (i.e., mottle and reload). The embodiments disclosed herein may similarly be applied to magnetic brush development systems which do not include donor rolls. Such systems are generally known, for example, as disclosed in U.S. Pat. No. 4,338,880, herein incorporated by reference in its entirety.

While this invention has been described in connection with what is presently considered to be the most practical and preferred embodiment, it is to be understood that it is capable of further modifications and is not to be limited to the disclosed embodiment, and this application is intended to cover any variations, uses, equivalent arrangements or adaptations of the invention following, in general, the principles of the invention and including such departures from the present disclosure as come within known or customary practice in the art to which the invention pertains, and as may be applied to the essential features hereinbefore set forth and followed in the spirit and scope of the appended claims.

What is claimed is:

1. A method for controlling a printing device in the presence of reload defects, comprising:

printing an image of a print job on an image transfer member of the printing device;

determining the density of the image or a portion thereof that was printed; and subsequently printing a scheduled control patch on the image transfer member if the density of the image is less than a predetermined density threshold;

wherein in determining the density of the image, the density of the image is inferred from its input image content.

2. The method according to claim 1, wherein in determining the density of the image, the density of the image is measured using a sensor.

3. The method according to claim 1, wherein the predetermined density threshold is approximately 55% area coverage.

4. The method according to claim 1, wherein the control patch is printed in an inter-document zone (IDZ) and the image is printed on an image zone on the image transfer member.

5. The method according to claim 1, wherein the printing of the control patch is rescheduled to a later instance.

6. A method for controlling a printing device in the presence of reload defects, comprising:

printing a control patch on an image transfer member of a printing device;

determining the density of an image of a print job or a portion thereof to be printed; and subsequently printing the image on the image transfer member if the density of the image is less than a predetermined density threshold wherein in determining the density of the image, the density of the image is inferred from its input image content.

7. The method according to claim 6, wherein if the density of the image is not less than the predetermined density threshold, then:

skipping at least one image zone on the image transfer member; and subsequently printing the image.

8. The method according to claim 7, comprising: wherein the number of skipped image zones is dynamically determined from the reload potential of the image stream.

9. The method according to claim 7, further comprising: printing a control patch in the at least one image zone.

10. The method according to claim 6, wherein the predetermined density threshold is approximately 20% area coverage.

11. The method according to claim 6, wherein the control patch is printed in an inter-document zone (IDZ) and the image is printed on a image zone on the image transfer member.

12. A system for controlling a printing device in the presence of reload defects, comprising:

an image transfer member for receiving images of a print job and control patches; and a controller configured to print a scheduled control patch immediately after a image of the print job if the density of the image or a portion thereof is less than a predetermined density threshold;

wherein determining the density of the image, the density is inferred from its input image content.

13. The system according to claim 12, wherein the density of the image is measured using a sensor.

14. The system according to claim 12, wherein the predetermined density threshold is approximately 20% area coverage.

15. The system according to claim 12, wherein the control patch is printed on an inter-document zone (IDZ) and the image is printed on an image zone of the image transfer member.

16. A system for controlling a printing device in the presence of reload defects, comprising:

an image transfer member for receiving images of a print job and control patches; and a controller configured to print an image of the print job after a control patch is printed, if the density of the image or a portion thereof is less than a predetermined density threshold;

wherein in determining the density of the image the density of the image is inferred from its input image content.

17. The system according to claim 16, wherein if the density of the image is not less than the predetermined density threshold, then:

skipping at least one image zone on the image transfer member; and subsequently printing the image.

18. The system according to claim 17, comprising: wherein the number of skipped image zones is dynamically determined from the reload potential of the image stream.

19. The system according to claim 17, further comprising printing a control patch in the at least one image zone.

20. The system according to claim 16, wherein the predetermined density threshold is approximately 20% area coverage.

21. The system according to claim 16, wherein the control patch is printed in an inter-document zone (IDZ) and the image is printed on an image zone on the image transfer member.

* * * * *